US005363084A

United States Patent [19]

Swinehart

[11] Patent Number: 5,363,084

[45] Date of Patent: Nov. 8, 1994

[54] FILM RESISTORS HAVING TRIMMABLE ELECTRODES

[75] Inventor: Philip R. Swinehart, Columbus, Ohio

[73] Assignee: Lake Shore Cryotronics, Inc., Westerville, Ohio

[21] Appl. No.: 24,273

[22] Filed: Feb. 26, 1993

[51] Int. Cl.[5] ..... H01C 1/012

[52] U.S. Cl. ..... 338/308; 338/22 R; 338/195; 338/309

[58] Field of Search ..... 338/22 R, 225 D, 308, 338/309, 306, 322, 195

[56] References Cited

U.S. PATENT DOCUMENTS

| | | | |
|---|---|---|---|
| 4,359,372 | 11/1982 | Nagai et al. | 204/192 |
| 4,401,881 | 8/1983 | Saito | 338/309 X |
| 4,453,151 | 6/1984 | Leary et al. | 338/34 |
| 4,780,598 | 10/1988 | Fahey et al. | 338/22 R |
| 4,983,944 | 1/1991 | Uchida et al. | 338/22 R |
| 5,015,986 | 5/1991 | Uchida et al. | 338/22 R |
| 5,045,828 | 9/1991 | Kulwicki et al. | 338/35 |
| 5,065,221 | 11/1991 | Imamura | 338/195 X |

OTHER PUBLICATIONS

V. Comello, "Photodetector Sets Speed Record for Silicon", *R&D Magazine,* p. 51 (Dec. 1993).

L. Spitz, "Trimmed for Precision", *Electronic Packaging & Productions,* pp. 48–49 (Oct. 1985).

*Primary Examiner*—Marvin M. Lateef

*Attorney, Agent, or Firm*—Nixon & Vanderhye

[57] ABSTRACT

Thin or thick film resistor devices (e.g., electronic resistors and thermistors) are trimmable without disturbing the active resistor film or necessarily requiring temperature control during trimming by providing a plurality of electrically conductive fingers having one end integral with one of the electrodes and a terminal end which extends at least substantially across the cross-wise dimension of the resistance film. The electrode fingers thereby electrically bridge a respective surface region of the substrate on which the electrodes and film are disposed. One or more of these fingers may thus be severed from the electrodes at the bridged respective surface region of the substrate so that the resistance value of the device can be controllably selected. By providing various finger-to-finger separation dimensions (to thereby establish various widths of segments of the active resistor film), a large number of resistance trimming combinations can be provided so that virtually any desired resistance value for the device can be obtained in dependence upon the particular finger(s) which is(are) severed. The resistance of very high resistance thermistors may also easily be reduced (e.g., by factors of 100 or more) to an extent where impedance loading measuring errors are minimized (if not eliminated entirely), or low TCR circuit resistors are varied in resistance as desired over a wide range without having to change the formulation of the resistor body material.

24 Claims, 1 Drawing Sheet

FILM RESISTORS HAVING TRIMMABLE ELECTRODES

FIELD OF INVENTION

This invention relates generally to thin and thick film resistors, and more particularly to means which enable the resistance value of the film resistor to be adjusted i.e., trimmed) without disturbing the active body of the resistor.

BACKGROUND AND SUMMARY OF THE INVENTION

Thin and thick film resistors are commonly used for sensors and electronics resistors in hybrid, integrated and printed circuit board-level electrical circuits. Metal resistors may include platinum resistance thermometers for temperature sensing, nickel/chrome alloys for low temperature coefficient of resistance (TCR) electronics resistors, and the like. Metal films have inherently low resistivities (specific resistances) and thus must be made in long "wire" shapes, usually folded into a serpentine configuration, in order to provide a resistance of sufficiently large magnitude so that a useable voltage drop (signal) can be obtained.

Conventional metal film resistors having serpentine configurations, however, occupy a considerable amount of valuable circuit area which, in turn, limits the range of resistance values available to the circuit designer. Nonetheless, the resistance values of such resistors can be adjusted (i.e., trimmed) easily to accurate values by providing "loops" or "links" of excess conducting material that can be cut by various methods (for example, lasers, sandblasters, ultrasonic cutting tools, miniature saws, or the like) without disturbing the remaining conducting material.

In the case of higher resistivity materials, such as ruthenium dioxide or bismuth ruthenate thick film materials, the high resistivity allows adequate resistance values to be obtained in a simple rectangle or square shape with electrical contacts on either side. For these resistors, trimming is usually accomplished by cutting into the sides of the active bodies of the resistors with a laser, although occasionally a few trimmable "links" are incorporated physically into the resistors. Highly accurate resistor-to-resistor uniformities can thus be obtained by real time measurement of the resistance value while the resistor is being trimmed. For real time measurements on resistor materials having a high temperature coefficient of resistance (TCR) during laser trimming, heat sinking or some other compensating method must be practiced in order to obtain the highest accuracy.

The usefulness of the laser trimming method is greatly enhanced, however, when employed to trim electronic circuit film resistors having very low TCR's because the laser heat has a minimal effect on the measured resistance value. However, even with such low TCR resistors, the laser trimming method can melt bordering material during the trimming operation which changes the nature of that material thereby usually causing drift in the resistance values. As a result, the trimming accuracy is decreased and the overall cost of the resistor is increased.

Thermistors having either a negative temperature coefficient of resistance (NTCR) whereby resistance decreases with an increase in temperature, or high positive temperature coefficient of resistance (PTCR) whereby resistance increases with an increase in temperature, are special applications of high resistivity resistors because they are used to measure temperature, control current surges or to prevent thermal run-away in electronic circuits. A relatively large resistivity change per unit temperature is desirable in such thermistors to allow a sufficiently large signal to be generated. However, a large resistivity change limits the useful temperature range of the thermistor since the resistance value will quickly increase to an extent whereby excessive errors in the measuring circuit result. Thus, if a thin or thick film with, for example, a high resistivity and high NTCR is to be used, a simple square or rectangular geometry of the active resistance material is not adequate.

In such situations, the overall resistance of conventional thermistor devices is frequently decreased (without decreasing the material-specific resistivity and temperature coefficient) by reducing the distance between the pair of electrodes and increasing the body width of the resistor. For example, as disclosed in U.S. Pat. No. 4,359,372, a reduced distance between electrodes and increased body width of the resistor can be embodied in a serpentine configuration so that the sum of the resistor body and electrical contacts can in effect mimic a more "rectangular" shape. However, there is a practical limit to this conventional technique since ultra-fine electrode geometries typically exceed the capabilities of thick film fabrication technology. Furthermore, accurate trimming of conventional devices of the type described in U.S. Pat. No. 4,359,372 (see FIGS. 3–5 therein) becomes increasingly more difficult to accomplish as the electrode geometry becomes more fine and/or complex.

What has been needed in this art, therefore, is a film resistor having an electrode geometry which can more easily and accurately be trimmed to a desired resistance value without disturbing the active body of the resistor (e.g., upsetting the temperature equilibrium of the resistor during trimming or causing drift by changing the material of the body). It is towards fulfilling such a need that the present invention is directed.

Broadly, the present invention is embodied in a film resistor having an opposed pair of electrodes laterally positioned with respect to an active resistor body so as to establish a region of the insulating substrate interposed between each electrode and the active resistor body. The electrodes, moreover, are most preferably provided with interdigitated fingers which extend across (i.e., bridge) a respective one of the substrate regions and into electrical communication (contact) with the active resistor body.

Thus, according to the present invention, the resistance value of a high resistivity film resistor device can, for example, be adjusted in a gross manner so as to lower drastically the resistance value to within values useable by conventional circuitry (e.g., by factors of 100), while also permitting selective and precise (fine) resistance value adjustment (e.g., by trimming to about 1% of the desired resistance value). Furthermore, resistance trimming can be accomplished with the film resistors of this invention without compromising the active resistor body simply by severing one or more of the fingers from the remaining electrode material at a location which is coextensive with the substrate region. The temperature of the resistors of this invention also does not necessarily need to be controlled during the trimming operation (but could be, if desired) since the finger(s) to be severed so as to achieve a desired resistance value can simply be computed once the overall resistance value at a given temperature is known.

Further aspects and advantages of this invention will become more clear after careful consideration is given to the following detailed description of the preferred exemplary embodiments.

BRIEF DESCRIPTION OF THE ACCOMPANYING DRAWING

Reference will hereinafter be made to the accompanying drawing wherein FIG. 1 depicts a schematic perspective view of a trimmable film resistor according to the present invention.

DETAILED DESCRIPTION OF THE PREFERRED EXEMPLARY EMBODIMENTS

Figure 1:
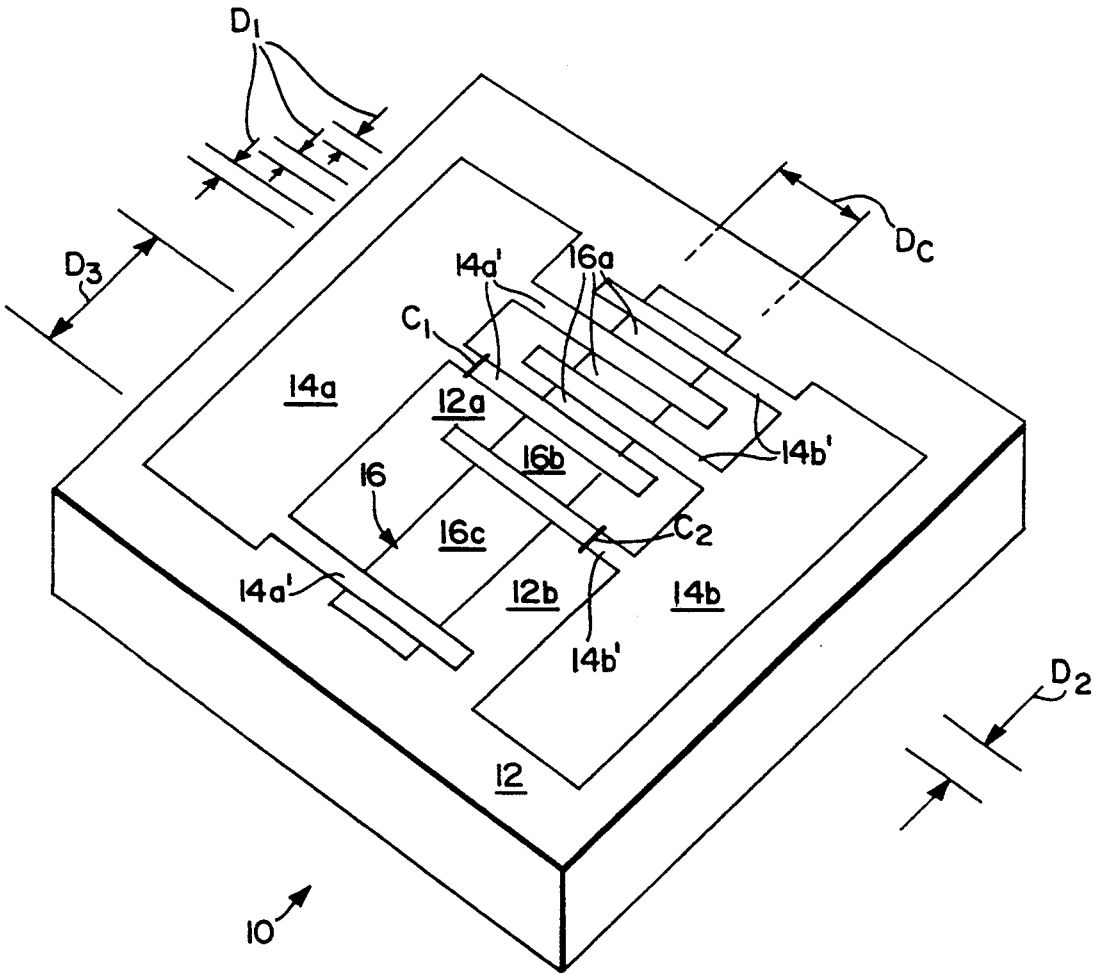

Accompanying FIG. 1 shows in schematic fashion a preferred film resistor 10 according to this invention. As is seen, the film resistor 10 is generally comprised of a suitable electrically insulating substrate 12 which carries on one of its surfaces a pair of electrodes 14*a*, 14*b* and an active resistor (or thermistor) body 16. The electrodes 14*a*, 14*b* are, moreover, positioned laterally of the active resistor body 16 so as to establish regions 12*a*, 12*b* of the substrate 12 which are disposed between the electrodes 14*a*, 14*b* and the active resistor body 16.

Important to the present invention, each of the electrodes 14*a*, 14*b*, includes several integral elongate fingers 14*a*′, 14*b*′ which extend entirely across (i.e., bridge) the interposed substrate regions 12*a*, 12*b*, respectively, and into electrical communication with the active resistor body 16. That is, the fingers 14*a*′, 14*b*′ are each sufficiently elongate so as to be in electrical contact with the active resistor body. Preferably, however, the fingers 14*a*′, 14*b*′ are sufficiently elongate to extend at least substantially entirely across the width-wise dimension $D_c$ of the active resistor body 16. In the embodiment shown in accompanying FIG. 1, it will be observed that the fingers 14*a*′, 14*b*′ are sufficiently elongate (i.e., have a dimension as measured parallel to the width-wise dimension $D_c$ of the active resistor body 16) so as to extend entirely across the active resistor material 14 and slightly onto an opposite one of the substrate regions 12*a*, 12*b*. Furthermore, it will be observed that the fingers 14*a*′, 14*b*′ are interdigitated—that is, the fingers 14*a*′ and 14*b*′ are alternately positioned relative to one another in electrical communication with the active resistor body 16 relative to the resistor body's longitudinal dimension.

The spacing dimensions between the fingers 14*a*′, 14*b*′ can be the same or, more preferably in terms of greater trimming selection, can be varied. Therefore, as shown in FIG. 1, at least some of the fingers 14*a*′, 14*b*′ are separated by a first length-wise dimension $D_1$ (i.e., measured transverse to the widthwise dimension $D_c$ of the active resistor body 16) which establish active resistor body segments 16*a* having a length which corresponds to that length-wise dimension, while others of the fingers 14*a*′, 14*b*′ are separated by length-wise dimensions $D_2$ and/or $D_3$ which establish active resistor body segments 16*b* and 16*c*, respectively, which correspond to those length-wise dimensions, each of which, in the embodiment shown, is increasingly greater than dimension $D_1$. Of course, other finger-to-finger length-wise separation dimensions (e.g., not shown dimensions $D_4$, $D_5$ and so on, which are different from the separation dimensions $D_1$, $D_2$ and/or $D_3$ and thereby establish active resistor body segments having different such length-wise dimensions) can be incorporated into the film resistor 10 according to this invention so as to provide the circuit designer with a wide range of trimming possibilities to achieve a desired resistance value.

The electrodes 14*a*, 14*b* and their associated fingers 14*a*′, 14*b*′ can be fabricated according to conventional patterning techniques (e.g., photolithography, silk screening or the like) and can, moreover, be positioned either under or over the active resistor body 16. Since the fingers 14*a*′ and 14*b*′ are alternately positioned relative to one another, each one of the fingers 14*a*′ and 14*b*′ (exclusive of the end-most fingers) will have a pair of fingers 14*b*′ or 14*a*′, respectively, of opposite polarity on either side. As a result, electrical current will flow in both directions along the active resistor body 16 from any one of the fingers 14*a*′ and 14*b*′. Such an arrangement places the active resistor body segments 16*a*–16*c* in parallel with one another thereby reducing the total resistance between the electrodes 14*a*, 14*b* as compared to conventional electrode geometries, while at the same time permitting the overall active resistor body 16 to be a convenient rectangular geometry.

The resistance value of the film resistor 10 according to this invention can easily and reliably be trimmed to a selected desired value without disturbing the active resistor body 16 (and thereby reducing if not eliminating the possibility for drift) by severing (electrically disabling) one or more of the fingers 14*a*′ and/or 14*b*′ from its associated respective electrode 14*a*, 14*b* at a location which is coextensive with a respective one of the substrate regions 12*a*, 12*b*. For example, accompanying FIG. 1 shows one of the fingers 14*a*′ and 14*b*′ being severed at locations $C_1$ and $C_2$ coextensive with substrate regions 12*a*, 12*b*, respectively. Severing a finger 14*a*′ for example which is between two other fingers 14*b*′ having the same polarity will electrically disable (short out) the two resistor segments 16*a* on either side of the severed finger 14*a*′.

Thus, for example, severing an end finger will increase the overall resistance the exact amount of the removal of one parallel segment from the circuit. Severing a finger which is positioned second from the end finger will increase the resistance by the same proportion as severing both the first and second fingers since in the former case, the end finger is left intact and the first and third fingers are of the same electrical potential and therefore no current flows eliminating the two segments from the circuit. However, when the third finger is severed, the first and fourth finger are of opposite potentials, and the series sum of the three included segments will then be in parallel with the remaining original segments. Thus, for thin films, the conducting fingers short out the resistor body which is in contact with them because the conducting path through the thickness of the film is significantly shorter than that in the plane of the film For much thicker films, however, a greater proportion of the electrical current may pass along the plane of the film, and the trimming algorithm would thus need to be suitably modified.

Since a higher segment resistance will result in a smaller change when it is removed from a circuit, once the resistance of a film resistor of this invention is known (at a known temperature for a thermistor), a computation can be made to determine which one(s) of the fingers 14*a*′ and/or 14*b*′ should be severed to obtain the desired resistance value. As an example, if it is assumed that a thin film is provided with a resistivity at 475° K (approximately 200° C.) of 4750 ohms/square, 10,000 ohms/square at 300° K. (room temperature), and 10,000,000 ohms/square at liquid helium temperature (4.2° K.) (the resistivity in ohm-m being ohms/square x t, where t is the thickness in meters of the active resistor body as measured transverse to the substrate plane), then a resistance of 10 Mohms would cause considerable error in a voltmeter with 10 to 100 Mohm input impedance. If ten (10) segments 16*a*, for example, each 0.1 square in length were positioned in parallel according to this invention, however, the resistance would be reduced by a factor of 100—i.e., to 100,000 ohms at 4.2° K., 100 ohms at 300° K. and 47.5 ohms at 475° K.—values that are well within conventional measurement range.

As can be understood from the example provided above, the film resistors 10 according to this invention do not necessarily need to be under strict temperature control during the trimming operation. That is, since the resistivity of the film resistor 10 at a given temperature will be known (or can easily be measured), the circuit designer can simply compute which one(s) of the fingers need to be severed in order to obtain a desired trimmed resistivity thereby avoiding the necessity to exercise temperature control during the trimming operation. For a zero TCR circuit resistor, of course, temperature control would be unnecessary in any event.

The film resistors 10 of this invention could be designed so as to have a constant preselected finger-to-finger separation distance. Additionally (or alternately), the resistors 10 could be provided with fingers 14*a*' and/or 14*b*' of varying finger-to-finger spacings to thereby establish active body segments having varying dimensions as measured transverse to the dimension $D_c$ (i.e., dimensions $D_1$, $D_2$, $D_3$, etc.). The smallest ones of the segments (e.g., active resistor body segments 16*a* as depicted in FIG. 1) would thereby provide for coarse trimming. In the example discussed above having the equal regime therefore, if an end-most one of the fingers adjacent to an active resistor body segment of 0.1 unit in length was severed, then a resistance increase of 10% would be obtained. Severing two adjacent interior fingers 14*a*', 14*b*' surrounding similarly sized segments 16*a*, on the other hand, would then place an active resistor body segment of 0.3 unit in length in parallel with the seven remaining segments, producing an increase in resistance of Furthermore, an active resistor body segment which has a unit length of two full squares in parallel with ten segments of 0.1 unit in length would produce only a 0.5% resistance change if severed from the end of the resistor. Thus, the thermistor could contain ten fingers, for example, having a finger-to-finger spacing dimension to establish active resistor body segments of 0.1 square in length in parallel with other segments each having a length-wise dimension of 0.2 square, 0.3 square, 0.5 square, 0.8 square and 2 squares to provide a number of possible combinations of trimming increments.

The thin or thick film resistors and thermistors of this invention can be fabricated from any suitable material typically employed for such purposes. Thus, for example, the active resistor body 16 can be formed of silk screened and fired pastes of the conducting and nonconducting oxides of Si and metals such as Re, Ru, Bi, Ni, Co, Zn, Mo, W and the like, sputtered thin films composed of alloys and mixtures of the oxides and nitrides of metals such as Ti, Nb, Zr, Ta and Hf, doped semiconductor films of SiC, Si and Ge, as well as insulator mixtures with conventional metals ("cermets") such as Pt particles in $Al_2O_3$ or gold particles in germanium. The electrodes 14*a* and 14*b*, on the other hand, can be fabricated from virtually any suitable metal layer or layers which establishes reliable electrical communication with the active resistor body 16 such as Pt, Cr, Mo, W, Ru, R/q, Pd, Re, Sn, Ni, In, A1, Ag and the like, as well as conducting oxides of Re, Ru, Mo, W,(In, Sn nonstoichiometric oxides), Pt, Rh, Os, Ir, Ti and the like. The substrate 12 can be any electrically insulative material (e.g., alumina, sapphire and the like) which is compatible with the materials from which the active resistor body 16 and electrodes 14*a*, 14*b* are formed.

The present invention will be further described and illustrated by way of the following non-limiting examples, wherein the reference numerals identify structures shown in FIG. 1.

EXAMPLES

Thermistors were made of thin films of zirconium oxynitride with bodies (16) having a width-wise dimension $D_c$=0.010 inch, seven equal segments (16*a*) 0,002 inch long, with fingers (14*a*', 14*b*' ) 0.002 inch wide extending across respective substrate areas (12*a*, 12*b*) 0.004 inch wide and completely across the thermistor body (16). The electrical contacts (14*a*, 14*b*) were platinum under gold, and the substrate (12) was R-cut sapphire. The specific sensitivity of this wafer was about −1 in the room temperature region.

Samples were cut and wire bonded into open (lids not installed) sensor packages. The devices were measured at 22°±0.5° C. using a current source at 100 microamps±0.05% and a 5-place digital multimeter with Kelvin (4-point) clip contact. The devices were held under a microscope with tweezers and trimmed using a carbide needle. The devices were not touched with fingers, and a cold fiber optic light source was used to avoid changing the device temperature. Repeated readings of the same device in the same initial state showed a noise level of±a few microvolts. The trimming sequence and comparison of theoretical and actual trimming results are noted below in Table 1.

TABLE 1

| Device No. | Untrimmed Resistance (Ohms) | Finger No. Cut | Trimmed Resistance (Ohms) | % Increase Actual | % Increase Theoretical |
|---|---|---|---|---|---|
| A-1 | 41.9 | 1 | 48.7 | 16.2 | 16 |
| | | 1 & 2 | 58.5 | 39.6 | 40 |
| | | 1–3 | 73.4 | 75.1 | 75 |
| | | 1–4 | 97.8 | 233.3 | 233 |
| | | 1–5 | 146.5 | 349.6 | 350 |
| | | 1–6 | 290.8 | 694 | 700 |
| A-2 | 40.2 | 2 | 56.3 | 39.9 | 40 |
| | | 2 & 3 | 64.8 | 61.2 | 61.5 |
| | | 2–4 | 93.8 | 233.5 | 233 |
| | | 2–5 | 128.2 | 318.9 | 318.2 |
| | | 2–6 | 280.1 | 696.9 | 700 |
| | | 2–7 | 1924 | 4787 | 4900 |
| A-3 | 41.8 | 4 | 58.4 | 39.7 | 40 |
| | | 4 & 7 | 96.5 | 230.9 | 233 |
| A-4 | 48.0 | 3 & 5 | 111.1 | 231.7 | 233 |
| A-5 | 41.4 | 2 | 57.7 | 39.4 | 40 |

The above data demonstrate that the resistance values of film resistors according to this invention can be trimmed accurately. In addition, the film resistors of this invention allow a circuit designer to select a desired resistance value for a particular resistor due to the number of possible combinations of trimming increments that are provided. Low TCR resistors according to this invention may therefore be varied in resistance as desired over a wide range without having to change the formulation of the resistor body material.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A resistor device comprising:

an electrical insulating substrate;

a pair of separated electrically conductive electrodes on a surface of said substrate;

an electrical resistance film formed on said substrate surface between said separated electrodes and having a width-wide dimension such that regions of said substrate surface are interposed between said film and each of said electrodes; and a plurality of electrically conductive fingers each having one end integral with one of said electrodes and a terminal end which is in electrical contact with said film, said fingers between said one and terminal ends thereof electrically bridging a respective one of said interposed substrate surface regions; wherein at least one of said electrically conductive fingers is severed at a location coextensive with said respective one of said interposed substrate surface regions without disturbing said electrical resistance film to achieve a selected resistance value for said resistor device.

2. A resistor device as in claim 1, wherein said electrically conductive fingers are sufficiently elongate to extend at least substantially across said width-wise dimension of said film.

3. A resistor device as in claim 1, wherein said fingers of one said electrodes are alternately disposed relative to said fingers of the other of said electrodes.

4. A resistor device as in claim 3, wherein said alternately disposed fingers are separated by a predetermined dimension so as to establish respective segments of said electrical resistance film having a length corresponding to said predetermined dimension.

5. A resistor device comprising:

an electrical insulating substrate;

a pair of separated electrically conductive electrodes on a surface of said substrate;

an electrical resistance film formed on said substrate surface between said separated electrodes and having a width-wise dimension such that regions of said substrate surface are interposed between said film and each of said electrodes; and a plurality of electrically conductive fingers each having one end integral with one of said electrodes and a terminal end which is in electrical contact with said film, said fingers between said one and terminal ends thereof electrically bridging a respective one of said interposed substrate surface regions; wherein said fingers of one of said electrodes are alternately disposed relative to said fingers of the other of said electrodes such that at least one pair of said alternately disposed fingers is separated by a first predetermined dimension which is different from a second predetermined dimension separating at least one other pair of said alternately disposed fingers so as to establish respective segments of said electrical resistance film having lengths corresponding to said first and second predetermined dimensions and thereby establish respectively different resistance values of said electrical resistance film upon severing of at least one of said alternately disposed fingers; wherein said fingers are severable at a location coextensive with said respective one of said interposed substrate surface regions such that severing at least one finger of said one and other pairs of said alternately disposed fingers changes a resistance value of said resistor device to an extent corresponding to said respectively different resistance value of said electrical resistance film.

6. A resistor device as in any one of the preceding claims, in the form of a termistor.

7. A film resistor comprising:

a substrate;

an active resistor body disposed on said substrate; and electrodes disposed on said substrate laterally of said active resistor body such that respective regions of said substrate separate said electrodes from said active resistor body; wherein said electrodes include several fingers which extend across said respective substrate regions into electrical communication with said active resistor body, said fingers being severable at a location coextensive with said respective substrate regions to disable electrical communication with said film resistor without disturbing said active resistor body and thereby obtain a desired resistance value thereof.

8. A film resistor as in claim 7, wherein said fingers of one of said electrodes are alternately disposed in electrical communication with said active resistor body relative to said fingers of the other of said electrodes.

9. A film resistor as in claim 8, wherein said alternately disposed fingers are separated from one another by a predetermined dimension so as to establish respective segments of said active resistor body having a length corresponding to said predetermined dimension.

10. A film resistor as in claim 8, wherein at least one pair of said alternately disposed fingers of said one and other electrodes is separated from one another by a first dimension so as to establish at least one respective segment of said active resistor body having a length corresponding to said first predetermined dimension, and wherein at least one other pair of said alternately disposed fingers of said one and other electrodes is separated from one another by a second dimension which is greater than said first dimension so as to establish at least one other segment of said active resistor body having a length corresponding to said second dimension.

11. A film resistor as in claim 7, wherein said fingers extend entirely across said active resistor body.

12. A film resistor as in any one of claims 7–11, in the form of a thermistor having a negative or positive temperature coefficient.

13. In a trimmable film resistor comprising an insulating substrate, an active resistor body disposed on a surface of said substrate, and a pair of electrodes disposed on said surface of said substrate in electrical communication with said active resistor body, the improvement wherein:

several elongate fingers extend from each one of the electrodes toward each other of the electrodes such that fingers of said each one of the electrodes are alternately disposed on said active resistor body relative to fingers of said other of the electrodes; and wherein surface regions of said substrate are interposed between said active resistor body and said electrodes such that said fingers of each one of said electrodes extend across a respective one of said surface regions; and wherein at least one of said several elongate fingers is severed at a location coextensive with said respective one of said interposed surface regions to disable electrical communication of said at least one of said several elongate fingers with said active resistor body and obtain a desired resistance value thereof.

14. In a trimmable film resistor as in claim 13, wherein said alternately disposed fingers are separated by a predetermined dimension so as to establish respective segments of said active resistor body which have a length corresponding to said predetermined dimension.

15. In a trimmable film resistor as in claim 13, wherein at least one pair of said alternately disposed fingers is separated by a first predetermined dimension so as to establish at least one segment of said active resistor body which has a length corresponding to said first predetermined dimension, and wherein at least one other pair of said alternately disposed fingers is separated by a second dimension which is different from said first dimension so as to establish at least one other segment of said active resistor body which has a length corresponding to said second predetermined dimension.

16. A method of trimming to a desired resistance value a film resistor having a substrate, an active resistor body disposed on a surface of said substrate, and a pair of electrodes disposed on said surface of said substrate laterally of said active resistor body so that a region of said substrate is established therebetween, each electrode having fingers which extend across a respective one of said substrate regions and are in electrical communication with said active resistor body, said method comprising severing one or more of said fingers at a location coextensive with said respective substrate region thereby obtaining the desired resistance value for the film resistor.

17. A method as in claim 16, wherein said step of severing one or more of said fingers is practiced with a mechanical cutting tool.

18. A method as in claim 16, wherein said step of severing one or more of said fingers is practiced with a laser.

19. A method as in claim 16, further comprising measuring the resistance value during severing of one or more of said fingers.

20. A method as in claim 16 or 19, further comprising controlling the temperature of the film resistor during said severing of one or more of said fingers.

21. A method as in claim 16, wherein said step of severing one or more of said fingers includes severing an end-most one of said fingers.

22. A method as in claim 16, wherein said step of severing one or more of said fingers includes severing an interior one of said fingers.

23. A method as in claim 16, wherein said film resistor has fingers which are spaced apart from one another by different dimensions so as to establish corresponding segments of said active resistor body therebetween having a length corresponding to a respective one of said different dimensions, said method comprising severing one or more of said fingers in dependence upon said length of said segments to achieve the desired resistance value.

24. A method as in claim 16 or 23, which further includes (i) measuring the resistance value of the film resistor at a given temperature prior to trimming, (ii) determining which one or more of said fingers are to be severed to obtain the desired trimmed resistance value at said given temperature, and (iii) severing said one or more of said fingers at a location coextensive with said respective substrate region without regard to the temperature of the film resistor.

* * * * *